US005386775A

United States Patent [19]

Poole et al.

[11] Patent Number: 5,386,775

[45] Date of Patent: Feb. 7, 1995

[54] AZIDE-FREE GAS GENERANT COMPOSITIONS AND PROCESSES

[75] Inventors: Donald R. Poole, Woodinville; Patrick C. Kwong, Seattle, both of Wash.

[73] Assignee: Automotive Systems Laboratory, Inc., Farmington Hills, Mich.

[21] Appl. No.: 81,013

[22] Filed: Jun. 22, 1993

[51] Int. Cl.[6] ..... C06B 95/00

[52] U.S. Cl. ..... 102/289; 102/290; 147/36

[58] Field of Search ..... 102/289, 290; 149/36

[56] References Cited

U.S. PATENT DOCUMENTS

| | | | |
|---|---|---|---|
| 3,668,873 | 6/1972 | Bauman | 60/211 |
| 3,909,322 | 9/1975 | Chang et al. | 149/19.4 |
| 3,954,528 | 5/1976 | Chang et al. | 149/19.4 |
| 4,369,079 | 1/1983 | Shaw | 149/2 |
| 4,370,181 | 1/1983 | Lundstrom et al. | 149/2 |
| 4,638,735 | 1/1987 | Lelu et al. | 102/290 |
| 4,865,667 | 9/1989 | Zevner et al. | 149/22 |
| 4,948,439 | 8/1990 | Poole et al. | 149/46 |
| 5,035,757 | 7/1991 | Poole | 149/46 |
| 5,035,757 | 7/1991 | Poole | 149/46 |
| 5,139,588 | 8/1992 | Poole | 149/61 |
| 5,160,386 | 11/1992 | Lund et al. | 149/88 |

*Primary Examiner*—Peter A. Nelson
*Attorney, Agent, or Firm*—Lyman R. Lyon

[57] ABSTRACT

Composition and process for inflating an automobile or aircraft occupant safety restraint bag which reduces the toxicity of the gases produced by gas generants. A relatively low energy nitrogen containing fuel is combined with a burn rate accelerator, such as an alkali metal salt, to form an azide-free gas generant composition which lowers the combustion temperature of the gas generants while also maintaining a rapid burn rate, thereby reducing toxicity of the resultant gases.

21 Claims, No Drawings

AZIDE-FREE GAS GENERANT COMPOSITIONS AND PROCESSES

BACKGROUND OF THE INVENTION

The present invention generally relates to gas generants used for inflating occupant safety restraints in motor vehicles.

Inflatable occupant restraint devices for motor vehicles have been under development worldwide for many years including the development of gas generating compositions for inflating such occupant restraints. Because of the strict requirements related to toxicity of the inflating gases, most, if not all, gas generants now in use are based on azides, particularly sodium azide.

However, the use of sodium azide, or other azides for that matter, results in extra expense and risk in gas generant manufacture because of the extreme toxicity of azides. In addition, the potential hazard and disposal problem of unfired inflation devices must be considered. Accordingly, nonazide gas generants provide significant advantages over azide-based gas generants with respect to these types of toxicity related concerns. Moreover, most azide-free gas generant compositions provide a higher yield of gas (moles of gas per gram of gas generant) than conventional occupant restraint gas generants.

Although an azide-free gas generating composition offers numerous advantages over an azide-based gas generant, one difficulty with the former involves reducing the production of toxic substances upon combustion to sufficiently low levels. The most difficult toxic gases to control are the various oxides of nitrogen ($NO_x$) and carbon monoxide (CO). This problem stems from the nature of azide-free gas generants, which consist of carbon and nitrogen containing ingredients. Upon combustion, these ingredients produce small, yet undesirable levels of $NO_x$ and CO, along with the desired products of nitrogen and carbon dioxide.

In combustion processes involving compounds containing both nitrogen and carbon, it is possible to reduce or eliminate the CO or $NO_x$ by manipulating the ratio of oxidizer to fuel, but this leads to a dilemma. On one hand, increasing the ratio of oxidizer to fuel minimizes the CO, because the extra oxygen oxidizes the CO to carbon dioxide. Unfortunately, however, this approach results in increased amounts of $NO_x$. On the other hand, if the ratio of oxidizer to fuel is lowered to eliminate excess oxygen and to provide a fuel rich condition which reduces the amount of $NO_x$ produced, then increased amounts of CO are produced.

Even though it is possible, by means of chemical equilibrium calculations, to find conditions of temperature, pressure, and gas generant composition which could reduce both $NO_x$ and CO to nontoxic levels, it has been very difficult to accomplish this result in actual practice.

This problem has heretofore been addressed in, for example, U. S. Pat. No. 5,139,588 which describes the use of additives consisting of alkali metal salts of organic acids to reduce the amount of $NO_x$ produced upon combustion of gas generants. The fuels used in these gas generants were from a group consisting of triazole, aminotetrazole, tetrazole, bitetrazole and metal salts of these compounds. These fuels are all energetic materials which result in high combustion temperatures. High combustion temperatures result in higher CO and $NO_x$ levels and although using excess oxygen to reduce CO levels and additives to reduce $NO_x$ levels improves the resulting gases, meeting existing toxicity requirements is still difficult.

One way to improve the toxicity of the combustion gases is to reduce the combustion temperature which would reduce the initial concentrations of both CO and $NO_x$. Although simple in theory, it is difficult in practice to reduce the combustion temperature and to also retain a sufficiently high gas generant burn rate for practical automobile airbag applications. The burn rate of the gas generant is important to insure that the inflator will operate readily and properly. As a general rule, the burn rate of the gas generant decreases as the combustion temperature decreases. By using less energetic fuels, specifically fuels which produce less heat upon combustion, the combustion temperature may be reduced but the gas generant burn rate is also reduced.

SUMMARY OF THE INVENTION

The problem that this invention addresses involves the relationship between combustion temperature and burn rate. The dilemma has been that if a lower combustion temperature is employed in order to reduce the toxicity of the resultant gases, then the gas generant burn rate would be relatively low as well.

It is therefore an object of the present invention to solve the aforesaid problem by providing a composition and process that combines the use of low energy fuels, which reduce the levels of nitrogen oxides ($NO_x$) and carbon monoxide (CO) by reducing the combustion temperatures, with the use of burn rate accelerators, formed from metal salts of organic acids, such as tetrazoles, bitetrazoles or triazoles, which maintain the gas generant burn rates high enough for use in inflatable occupant restraint devices typically used in motor vehicles.

In accordance with the present invention, an azide-free gas generating composition that forms gases on combustion useful for inflating an automobile or aircraft safety restraint device comprises at least one relatively low energy nitrogen containing fuel and at least one burn rate accelerator comprising alkali metal salts of organic acids.

The relatively low energy nitrogen containing fuel can be selected from the group consisting of guanidine nitrate, oxamide, ammonium oxalate, aminoguanidine bicarbonate, glycine nitrate, hydrazodicarbonamide or azodicarbonamide, and the organic acid can be selected from the group consisting of tetrazoles, bitetrazoles or triazoles, or from the group consisting of 5-aminotetrazole (5AT), 5-nitrotetrazole, 5-nitroaminotetrazole or bitetrazole.

The gas generant composition may also comprise a slag forming material and an oxidizer. The oxidizer can be selected from the group consisting of inorganic nitrates, nitrites and chlorates or perchlorates of alkali or alkaline earth metals.

The ratio of oxidizer to fuel is selected to provide a small excess of oxygen in the combustion products, with an oxygen content less than approximately 5% in the combustion products.

The slag forming material can be selected from the group consisting of clays, talcs, silica, aluminum oxide, aluminum hydroxide, aluminum silicate, magnesium silicate or ferrous silicate.

A metal salt selected from the group consisting of zinc salts or alkaline earth metal salts may also be used in conjunction with the alkali metal salts.

In further accordance with the present invention, a method of reducing or eliminating toxic nitrogen oxides and carbon monoxide upon combustion of a gas generant composition, while still maintaining a relatively high burn rate during combustion, comprises the step of combining a relatively low energy nitrogen containing fuel with a burn rate accelerator comprising an alkali metal salt of an organic acid. The relatively low energy nitrogen containing fuel can be selected from the group consisting of guanidine nitrate, oxamide, ammonium oxalate, aminoguanidine bicarbonate, glycine nitrate, hydrazodicarbonamide and azodicarbonamide, and the organic acid can be selected from the group consisting of tetrazoles, bitetrazoles or triazoles, or from the group consisting of 5-aminotetrazole, 5-nitrotetrazole, 5-nitroaminotetrazole and bitetrazole. The method can further comprise the steps of adding an oxidizer and a slag forming material.

DETAILED DESCRIPTION OF THE PREFERRED EMBODIMENT(S)

When utilizing azide-free gas generating compositions, the production of gases with sufficiently low levels of toxic substances has been difficult. Specifically, the $NO_x$ and CO are produced from these azide-free gas generants. The present invention relates to a composition and process for reducing the amount of these toxic gases.

The choice of combustion temperature based upon the relative energy levels of the respective fuels impacts the relative amounts of CO and $NO_x$ produced. For instance, high combustion temperatures result in higher CO and $NO_x$ levels. However, simply reducing the combustion temperature by using less energetic fuels creates a different difficulty, namely, a decreased gas generant burn rate. Thus, the burn rate also decreases as the combustion temperature decreases.

The present invention solves the aforesaid problem by combining the use of low energy fuels with a burn rate accelerator, formed from the alkali metal salts of organic acids, such as tetrazoles, bitetrazoles or triazoles, thereby reducing the levels of $NO_x$ and CO by reducing the combustion temperature, while also retaining a gas generant burn rate high enough to be acceptable for use as a means for inflating an airbag.

The low energy fuels are selected from compounds which have a large negative heat of formation and as high a nitrogen content as possible. Typically, these two requirements are difficult to reconcile because they are not found in a single compound. Tetrazoles, for example, have high nitrogen contents but also have high heats of formation, such as +585 calories per gram for 5-aminotetrazole, which leads to a high combustion temperature.

Guanidine nitrate, on the other hand, has a heat of formation of −843 calories per gram and a nitrogen content of 45.9% by weight. Although this is a low nitrogen content compared to tetrazoles, it is nevertheless high in relation to most other stable compounds. Other examples of compounds useful for low energy fuels are oxamide with a heat of formation of −1376 calories per gram, ammonium oxalate with a heat of formation of −2165 calories per gram, aminoguanidine bicarbonate with a heat of formation of −1044 calories per gram, glycine nitrate with a heat of formation of −1257 calories per gram, hydrazodicarbonamide with a heat of formation of −1009 calories per gram and azodicarbonamide with a heat formation of −602 calories per gram.

Moreover, the alkali metal salts provide the necessary function of increasing the gas generant burn rate. Zinc salts and alkaline earth metal salts are also useful in conjunction with alkali metal salts to enhance production of solid combustion products which coalesce into large, easily filtered "clinkers" or slag.

Of the alkali metals, lithium, sodium and potassium are preferred. The acids used to prepare the alkali metal salts are selected preferably from the family of tetrazoles and triazoles. Of the tetrazoles, salts of 5-aminotetrazole, 5-nitrotetrazole, 5-nitroaminotetrazole and bitetrazole are preferred, with the salts of 5-aminotetrazole most preferred because of cost availability and safety.

Formation of CO is further suppressed by providing an oxidizer as described in U.S. Pat. No. 5,139,588. The relative amounts of oxidizer and fuel used is selected to give a small excess of oxygen in the combustion products, thereby limiting the formation of CO. The oxidizer is chosen from inorganic nitrates, nitrites, chlorates or perchlorates of alkali or alkaline earth metals. The most preferred oxidizer is strontium nitrate because of the more easily filterable solid products formed as described in U.S. Pat. No. 5,035,757.

The oxygen content in the combustion products should be in the range of 0.1% to about 5%, and preferably from approximately 0.5% to 2%. The use of lower energy fuels in combination with alkali metal salts of organic acids results in a gas generant with both an acceptable burn rate and a reduced combustion temperature.

In addition, a slag former or enhancer is used. A material which functions as a slag former induces a filterable coherent mass or slag to form, as taught in U.S. Pat. No. 5,139,588 and 5,035,757. Slag formers can be selected from numerous compounds, such as clays, talcs, silica, aluminum oxide, aluminum hydroxide, aluminum silicate, magnesium silicate, ferrous silicate and others. Clay and talc are among the best.

Specifically, a composition having 28.62% 5AT, 57.38% strontium nitrate, 8.0% clay and 6.0% potassium 5-aminotetrazole (K5AT) exhibits a computer calculated equilibrium combustion temperature of 3962° F. (≈2183° C.) and equilibrium concentrations of 5302 ppm NO and 4538 ppm CO with a burn rate of 0.69 inches (≈1.8 cm) per second at 1000 psi.

By using a lower energy fuel, such as guanidine nitrate in place of 5AT and increasing the K5AT, the composition: 14.10% guanidine nitrate, 47.9% strontium nitrate, 8.0% clay and 30.0% K5AT has a calculated equilibrium temperature of 3309° F. (≈1821° C.) and equilibrium concentrations of 1963 ppm NO and 528 ppm CO with a burn rate of 0.74 inches (1.88 cm) per second at 1000 psi. The predicted reductions are, therefore, approximately 63% for NO and 88% for CO.

The present invention is illustrated by the following representative examples. The first four examples demonstrate the increased burn rate and decreased pressure exponent produced by increasing the relative amount of K5AT in the mixture. A relatively low pressure exponent, such as between zero and 0.6, is preferable. If the pressure exponent is high, such as at 0.7, then controlling the pressure is too difficult.

EXAMPLE 1

The low burn rates exhibited by most gas generants using guanidine nitrate can readily be seen by the following example.

A mixture of guanidine nitrate, strontium nitrate, bentonite clay and the potassium salt of 5-aminotetrazole was prepared having the following composition in percent by weight: 45.0% GN, 41.0% strontium nitrate, 8.0% clay, and 6.0% K5AT.

These materials were dry-blended and attrited in a ball-mill and pellets were then formed by compression molding.

The burn rate of the composition was found to be 0.12 inches (≈0.30 cm) per second at 1000 psi with a pressure exponent of 0.75.

The burn rate was determined by measuring the time required to burn a cylindrical pellet of known length. The pellets were compression molded in a one-half inch diameter die at approximately 16,000 pounds force and were then coated on the sides with an epoxy/titanium dioxide inhibitor which prevented burning along the sides.

EXAMPLE 2

A mixture of guanidine nitrate, strontium nitrate, bentonite clay and K5AT was prepared having the following composition in percent by weight: 27.0% GN, 45.0% strontium nitrate, 8.0% clay and 20.0% K5AT.

These examples were prepared and tested as described in Example 1. The burn rate of this composition was found to be 0.31 inches (0.78 cm) per second at 1000 psi with a pressure exponent of 0.62.

EXAMPLE 3

A mixture of guanidine nitrate, strontium nitrate, bentonite clay and K5AT was prepared having the following composition in percent by weight: 20.6% GN, 46.4% strontium nitrate, 8.0% clay and 25.0% K5AT.

These materials were prepared and tested as described in Example 1. The burn rate of this composition was found to be 0.44 inches (1.11 cm) per second at 1000 psi with a pressure exponent of 0.52.

EXAMPLE 4

A mixture of guanidine nitrate, strontium nitrate, bentonite clay and K5AT was prepared having the following composition in percent by weight: 14.1% GN, 47.9% strontium nitrate, 8.0% clay and 30.0% K5AT.

These materials were prepared and tested as described in Example 1. The burn rate of this composition was found to be 0.65 inches (1.65 cm) per second at 1000 psi with a pressure exponent of 0.34.

The following two examples involve the use of oxamide instead of guanidine nitrate as the relatively low energy fuel.

EXAMPLE 5

A mixture of oxamide, strontium nitrate, bentonite clay and K5AT was prepared having the following composition in percent by weight: 8.2% oxamide, 53.8% strontium nitrate, 8.0% clay and 25.0% K5AT.

These materials were prepared and tested as described in Example 1. The burn rate of this composition was found to be 0.69 inches (≈1.8 cm) per second at 1000 psi with a pressure exponent of 0.40.

EXAMPLE 6

A mixture of oxamide, strontium nitrate, bentonite clay and K5AT was prepared having the following composition in percent by weight: 12.0% oxamide, 55.0% strontium nitrate, 8.0% clay and 25.0% K5AT.

These materials were prepared and tested as described in Example 1. The burn rate of this composition was found to be 0.45 inches (≈1.1 cm) per second at 1000 psi with a pressure exponent of 0.39.

While the preferred embodiment of the invention has been disclosed, it should be appreciated that the invention is susceptible of modification without departing from the scope of the following claims.

We claim:

1. An azide-free gas generating composition that forms gases on combustion useful for inflating an automobile or aircraft safety restraint device comprising at least one relatively low energy nitrogen containing fuel and at least one burn rate accelerator comprising alkali metal salts of organic acids.

2. The gas generant composition of claim 1 wherein said relatively low energy nitrogen containing fuel is selected from the group consisting of guanidine nitrate, oxamide, ammonium oxalate, aminoguanidine bicarbonate, glycine nitrate, hydrazodicarbonamide or azodicarbonamide.

3. The gas generant composition of claim 1 wherein said organic acid is selected from the group consisting of tetrazoles, bitetrazoles or triazoles.

4. The gas generant composition of claim 1 wherein said organic acid is selected from the group consisting of 5-aminotetrazole, 5-nitrotetrazole, 5-nitroaminotetrazole or bitetrazole.

5. The gas generant composition of claim 1 further comprising a slag forming material.

6. The gas generant composition of claim 1 further comprising an oxidizer.

7. The gas generant composition of claim 6 wherein said oxidizer is selected from the group consisting of inorganic nitrates, nitrites and chlorates or perchlorates of alkali or alkaline earth metals.

8. The gas generant composition of claim 6 wherein the ratio of oxidizer to fuel is selected to provide a small excess of oxygen in the combustion products, with an oxygen content less than approximately 5% in the combustion products.

9. The gas generant composition of claim 8 wherein said ratio is such that the amount of oxygen allowed in the combustion products is less than approximately 2% of the combustion products.

10. The gas generant composition of claim 5 wherein the slag forming material is selected from the group consisting of clays, talcs, silica, aluminum oxide, aluminum hydroxide, aluminum silicate, magnesium silicate or ferrous silicate.

11. The gas generant composition of claim 1 further comprising a metal salt selected from the group consisting of zinc salts or alkaline earth metal salts.

12. The gas generant composition of claim 6 further comprising a slag forming material.

13. A method of reducing or eliminating toxic nitrogen oxides and carbon monoxide upon combustion of a gas generant composition, while still maintaining a relatively high burn rate during combustion comprising the step of combining a relatively low energy nitrogen containing fuel with a burn rate accelerator comprising an alkali metal salt of an organic acid.

14. The method of claim 13 wherein said relatively low energy nitrogen containing fuel is selected from the group consisting of guanidine nitrate, oxamide, ammonium oxalate, aminoguanidine bicarbonate, glycine nitrate, hydrazodicarbonamide and azodicarbonamide.

15. The method of claim 13 wherein said organic acid is selected from the group consisting of tetrazoles, bitetrazoles or triazoles.

16. The method of claim 13 wherein said organic acid is selected from the group consisting of 5-aminotetrazole, 5-nitrotetrazole, 5-nitroaminotetrazole and bitetrazole.

17. The method of claim 13 further comprising the step of adding an oxidizer.

18. The method of claim 13 further comprising the step of adding a slag forming material.

19. The method of claim 13 further comprising the step of adding a metal salt selected from the group consisting of zinc salts or alkaline earth metal salts.

20. The method of claim 17 further comprising the step of adding a slag forming material.

21. An azide-free gas generating composition that forms gases on combustion useful for inflating a vehicle safety restraint device comprising at least one relatively low energy nitrogen containing fuel and at least one burn rate accelerator comprising alkali metal salts of organic acids, wherein said at least one relatively low energy nitrogen containing fuel reduces levels of toxic oxides of nitrogen and carbon monoxide upon combustion by reducing combustion temperatures for said azide-free gas generating composition, and wherein said at least one burn rate accelerator maintains a relatively high burn rate for said azide-free gas generating composition.

* * * * *